US011319632B2

(12) United States Patent
Chen

(10) Patent No.: US 11,319,632 B2
(45) **Date of Patent: *May 3, 2022**

(54) SURFACE CTS ANTI-CORROSION TREATMENT METHOD FOR STAINLESS STEEL PART

(71) Applicant: SHENZHEN CANDORTECH INCORPORATED COMPANY, Shenzhen (CN)

(72) Inventor: Chao Chen, Shenzhen (CN)

(73) Assignee: SHENZHEN CANDORTECH INCORPORATED COMPANY, Shenzhen (CN)

( * ) Notice: Subject to any disclaimer, the term of this patent is extended or adjusted under 35 U.S.C. 154(b) by 489 days.

This patent is subject to a terminal disclaimer.

(21) Appl. No.: 16/326,177

(22) PCT Filed: Aug. 16, 2017

(86) PCT No.: PCT/CN2017/097656

§ 371 (c)(1),
(2) Date: Feb. 15, 2019

(87) PCT Pub. No.: WO2018/033096

PCT Pub. Date: Feb. 22, 2018

(65) Prior Publication Data

US 2019/0186021 A1 Jun. 20, 2019

(30) Foreign Application Priority Data

Aug. 16, 2016 (CN) ..... 201610673582.9

(51) Int. Cl.
*C25D 5/36* (2006.01)
*C25D 5/50* (2006.01)
(Continued)

(52) U.S. Cl.
CPC ..... *C23C 28/04* (2013.01); *C23C 22/40* (2013.01); *C23F 13/02* (2013.01); *C25D 11/36* (2013.01)

(58) Field of Classification Search
CPC ..... C25D 5/36; C25D 5/50; C25D 11/00
(Continued)

(56) References Cited

U.S. PATENT DOCUMENTS

| | | | | |
|---|---|---|---|---|
| 4,586,957 | A | 5/1986 | Masumoto et al. | |
| 2015/0090368 | A1 | 4/2015 | Katayama et al. | |
| 2019/0256982 | A1 * | 8/2019 | Chen | C25D 3/08 |

FOREIGN PATENT DOCUMENTS

| | | | | |
|---|---|---|---|---|
| CN | 102691059 A | * | 9/2012 | C25D 9/06 |
| CN | 102965649 A | | 3/2013 | |
| WO | 2015/089062 A1 | | 6/2015 | |

OTHER PUBLICATIONS

Qing, "Colouring of Stainless Steel and its Application," Electroplating & Finishing (Dec. 1993), vol. 12, No. 4, pp. 52-59. (Year: 1993).*

(Continued)

*Primary Examiner* — Edna Wong
(74) *Attorney, Agent, or Firm* — Lewis Roca Rothgerber Christie LLP

(57) ABSTRACT

Disclosed is a surface anti-corrosion treatment method for stainless steel. The method comprises the following steps: (1) performing chemical de-oiling and alkaline corrosion treatments on the surface of stainless steel by using a sodium hydroxide solution and a solution containing an alkaline corrosion active agent, and then washing with water; (2) performing, by using an oxidation solution, an oxidation treatment on the surface of the stainless steel treated in step (1), and then washing with water; (3) using the surface of the stainless steel treated in step (2) as a cathode and soaking same in an electrolyte for electrolysis, and then washing (Continued)

with water; and (4) placing the surface of the stainless steel treated in step (3) at a temperature of 50° C.-60° C. under a humidity of 60%-70%, and performing a hardening treatment. Also disclosed are the use of the treatment method in the treatment of a stainless steel part and a stainless steel part obtained after the treatment by means of the treatment method.

19 Claims, 9 Drawing Sheets

(51) Int. Cl.

| | |
|---|---|
| ***C25D 11/00*** | (2006.01) |
| ***C23C 28/04*** | (2006.01) |
| ***C25D 11/36*** | (2006.01) |
| ***C23C 22/40*** | (2006.01) |
| ***C23F 13/02*** | (2006.01) |

(58) Field of Classification Search
USPC ..... 205/320, 333, 218, 229
See application file for complete search history.

(56) References Cited

OTHER PUBLICATIONS

Ansari et al., "Improvement in the Corrosion Resistance of Stainless Steel 304L in Sodium Chloride Solution by a Nanoclay Incorporated Silane Coating," RSC Advances (2015), vol. 5, No. 1, pp. 706-716. (Year: 2015).*

Jung et al., "XPS Characterization of Passive Films Formed on Type 304 Stainless Steel in Humid Atmosphere," Corrosion Science (May 1, 2012), vol. 58, pp. 62-68. (Year: 2012).*

Carrillo et al., "Electrochemical Study of Oxyanions Effect on Galvanic Corrosion Inhibition," Int. J. Electrochem. Sci. (Sep. 1, 2012), vol. 7, No. 9, pp. 8688-8701. (Year: 2012).*

Song et al., "Development of a Molybdate-Phosphate-Silane-Silicate (MPSS) Coating Process for Electrogalvanized Steel," Corrosion Science (Jan. 1, 2006), vol. 48, No. 1, pp. 154-164. (Year: 2006).*

Mary et al., "Corrosion Inhibition by Oxyanions," Int J Nano Corr Sci and Engg. (2015), vol. 2, No. 3, pp. 46-59. (Year: 2015).*

M.J. Carmezim et al., "Electrochemical Behaviourof Thermally Treated Cr-Oxide Films Deposited on Stainless Steel", Corrosion Science, 2002, pp. 451-465, vol. 44, Elsevier Science Ltd.

Djordje Mandrino et al.,"Study of Oxide Protective Layers on Stainless Steel by AES, EDS and XPS", Surface and Interface Analysis, 2008, pp. 285-289, vol. 40, John Wiley & Sons, Ltd.

Fanyan Meng et al., "Intermediate-Temperature Oxidation of Fe—Cr—Ni—Mo Stainless Maraging Steel in Air", Applied Mechanics and Materials, 2013, pp. 192-196, vols. 423-426, Trans Tech Publications, Switzerland.

J.H. Qiu, "Passivity and Its Breakdown on Stainless Steels and Alloys", Surface and Interface Analysis, 2002, pp. 830-833, vol. 33, John Wiley & Sons, Ltd.

Azim Safikhani et al., "Effect of Ni—Mo Addition on Cyclic and Isothermal Oxidation Resistance and Electrical Behavior of Ferritic Stainless Steel for SOFCs Interconnect", International Journal of Hydrogen Energy, 2014, pp. 11210-11223, vol. 39, Elsevier Ltd.

* cited by examiner

SURFACE CTS ANTI-CORROSION TREATMENT METHOD FOR STAINLESS STEEL PART

CROSS-REFERENCE TO RELATED APPLICATION(S)

This application is a U.S. National Phase Patent Application of International Application Number PCT/CN2017/097656, filed on Aug. 16, 2017, which claims priority of Chinese Patent Application Number 201610673582.9, filed on Aug. 16, 2016, the entire contents of all of which are incorporated herein by reference.

TECHNICAL FIELD

The invention belongs to the field of oil refining, petrochemical, chemical industry and petroleum product processing equipment, in particular to a surface anti-corrosion treatment method of stainless steel components used in high corrosion industry environment such as oil refining, petrochemical, petroleum processing, chemical industry and so on.

BACKGROUND ART

There exist high corrosive medium environments, such as organic acids and chloride ions in oil refinery equipment, fatty acids in chemical industry equipment, $Cl^-$ in seawater treatment equipment, etc. in the equipment of oil refining, petrochemical, chemical industry and seawater treatment fields. Especially, in oil refining industry, the corrosion phenomenon is seriously aggravated due to the quality of crude oil. The quality of material becomes more and more important used in places where are easy to be corroded. A poor quality material is easy to be corroded, therefore, it needs to be shut down to replace and repair. While a high quality material has a high cost. There defects become a bottleneck, which restricts the production, processing and development in corrosive environments.

At present, there are many methods to prevent metal from corrosion. The methods comprise mainly: 1. improving the inherent corrosion resistance of metal materials; 2. coating or plating non-metallic materials or non-metallic protective layers; 3. treating corrosive media; 4. applying electrochemical protection.

Besides, the surface treatment method by forming a metal protective layer on metal surfaces is to plate an inactive metal or alloy on the metal surfaces of components as a protective layer to slow the corrosion rate, the metals used as the protective layer include usually zinc, tin, aluminum, nickel, chromium, copper, cadmium, titanium, lead, gold, silver, palladium, and various kinds of alloys; or plating a layer of metal or alloy on metal surfaces by electrodeposition; or forming a protective metal layer on metal surfaces by immersing the metal or products to be protected into melting metals; or putting powdery metal into a spray gun, melting the powdery metal at high temperature and spraying it onto the surface of the metal to be protected. The drawbacks of the above methods are: the fusion between coated metal and protective metal is not enough, thus the coating is hard and easy to peel off; and the preparation method is complexed difficult, not suitable for large scale production or fails to meet the requirement of processing or the corrosion resistance does not meet the requirement of actual situation.

SUMMARY OF THE INVENTION

As for the above problems, the present invention particularly presents a surface treatment method of stainless steel for corrosion-resistance, which has good anti-corrosion effect, simple process, low equipment requirements, is suitable for large-scale industrial applications and can be used under high corrosion environment.

The stainless steel components treated by this method include, but are not limited to, stainless steel plate corrugated filler, stainless steel wire mesh filler, stainless steel loose filler, tray plate, stainless steel float valves, and various fasteners and connectors. The maximum pitting resistance equivalent Pren value of the stainless steel treated by this method is between 40 and 58, which is increased by 1.5 to 2.3 times. The corrosion resistance of the treated stainless steel against chloride ions, sulfides, organic acids, etc. is significantly increased one grade than that of ordinary untreated 304, 316L, and 317L stainless steel, which is equivalent to the corrosion resistance of AL-6XN and 904L alloys. Besides, the total thickness of the stainless steel components treated by this method is 700-900 nm, and the surface of the treated materials combine with the substrate in an inlaid manner, their thermal expansion coefficients are equal and there is no obvious combining interface between them, such surface will not peel off from the substrate at high temperature for a long time. The pretreatment and post-treatment processes of this method are carried out under normal temperature and normal pressure, which is easy to be industrialized and applied to large-scale stainless-steel equipment.

The technical solution for achieving the above object is as follows:

The present invention provides an anti-corrosion method of a stainless steel surface, comprising the following steps:

(1) chemically degreasing and etching with alkali a stainless steel surface using a sodium hydroxide solution and a solution containing an alkali etching active agent, followed by washing with water;

(2) oxidizing the stainless steel surface treated in the step (1) by an oxidizing solution, followed by washing with water;

(3) immersing the stainless steel surface treated in the step (2) as a cathode in an electrolyte to electrolyze, followed by washing with water; (4) placing the stainless steel surface treated in the step (3) at a temperature of 50-60° C. and a humidity of 60-70% for hardening.

Preferably, in the step (1), the temperature of the sodium hydroxide solution and the solution containing the alkali etching active agent is 80-85° C.

Preferably, the concentration of the sodium hydroxide solution is 6.5-8%; Preferably, the concentration of the solution containing the alkali etching active agent is 0.3-0.5%.

Preferably, the alkali etching active agent is ethoxy modified polytrisiloxane.

Preferably, the chemically degreasing and etching with alkali treatment is performed for 10-15 minutes.

Preferably, the washing with water is performed by using water with a temperature of 80-85° C. for 3-5 minutes.

Preferably, in the step (2), the oxidizing solution contains 200-300 g/L of $CrO_3$ and 100-150 g/L of $Na_2MoO_4$.

Preferably, the temperature of the oxidizing solution is 75-90° C.

Preferably, the pH of the oxidizing solution is 0.4-1.5; preferably, the pH of the oxidizing solution is adjusted to 0.4-1.5 by adding a $H_2SO_4$ solution into the oxidizing solution; preferably, the concentration of the $H_2SO_4$ solution is 98%.

Preferably, the oxidizing treatment is performed for 15-35 minutes.

Preferably, the washing with water in the step (2) is performed cyclically by using water at 25-40° C. for 3-5 minutes; preferably, the pH of the water is >3.

Preferably, in the step (3), the electrolyte contains 100-150 g/L of $CrO_3$, 100-150 g/L of $Na_2MoO_4$, 200-250 g/L of $H_3PO_4$, 50-60 g/L of $Na_2SiO_3$.

Preferably, the temperature of the electrolyte is 40-52° C.;

Preferably, the pH of the electrolyte is 0.5-1.5; preferably, the pH of the electrolyte is adjusted to 0.5-1.5 by adding a $H_2SO_4$ solution into the electrolyte; preferably, the concentration of the $H_2SO_4$ solution is 98%;

Preferably, the current for performing the electrolysis is direct current; preferably, the intensity of the current is 40-5 $A/m^2$; preferably, the initial current intensity is 40 $A/m^2$, and then the current intensity is gradually reduced to 5 $A/m^2$ according to the formula i=3+A/t, wherein i is current intensity, t is time, A is a parameter of 20-30; preferably, the time for electrolyzing is 25-55 minutes.

Preferably, the electrolysis comprises electrolyzing for 10-25 minutes at an initial current intensity of 40 $A/m^2$, and then electrolyzing at a current intensity gradually reduced to 5 $A/m^2$ during 15-30 minutes.

Preferably, the washing with water is performed cyclically by using water 25-40° C. for 3-5 minutes; preferably, the pH of the water is >3.

Preferably, in the step (4), the time for hardening treatment by placing is 3-4 hours.

The stainless steels treated by the method according to the present invention include: stainless steel plate corrugated filler, stainless steel wire mesh filler, stainless steel loose filler, tray plate, stainless steel float valves, various fasteners and connectors.

The present invention also provides a use of the method according to the present invention in treating stainless steels; preferably, the stainless steels include: stainless steel plate corrugated filler, stainless steel wire mesh filler, stainless steel loose filler, tray plate, stainless steel float valves, various fasteners and connectors.

The present invention further provides a stainless steel obtained by the method according to the present invention.

To explain the objects, the technical features and the beneficial effects of the present invention more detailedly, the nanocrystal material of the present invention will be further described below in combined with 304 stainless steels.

As shown in FIG. 1, after being treated with the nanocrystalline material of the present invention, the 304 stainless steel substrate shows a dark color, which has great difference compared with the color of the untreated 304 stainless steel substrate (the left side of FIG. 1 is 304 stainless steel substrate, the right side of FIG. 1 is the 304 stainless steel substrate treated by the nanocrystalline material according to the present invention). The nanocrystalline material is observed by a metallographic microscope, and it is found that the nanocrystalline material has covered the surface intergranular of the original 304 stainless steel, which lead to prominent intergranular corrosion resistance, as shown in FIG. 2.

It can be seen that, in the prepared nanocrystalline material based on 304 stainless steel substrates according to the method of the present invention, the nanocrystalline material formed on the 304 stainless steel surface is combined with the 304 stainless steel substrate in an inlaid manner. The 304 stainless steel substrate material forms a honeycomb substrate structure on the surface the shallower to the deeper, and voids of the honeycomb substrate structure are filled with a hardened nanocrystalline material. Since there is no combining interface between the stainless steel substrate and the nanocrystalline material, the thermal expansion of the nanocrystalline material and the stainless steel substrate will not lead to obvious fault layers. When the temperature of the contacting medium fluctuates significantly, such inlaid manner will keep the film layer between the nanocrystalline material and the stainless steel substrate from falling off. The adhesion of the nanocrystalline material is far greater than that of coating and plating materials. As shown in FIG. 3, the blank area is 304 stainless steel substrate, and the nanocrystalline material of the present invention is combined with the substrate by means of being dense in the surface and sparse in inner layer.

The layers of the combined product of the substrate and the nanocrystalline material were analyzed by X-ray photoelectron spectroscopy, and it was found that the layers are, from the outermost surface layer to the innermost layer, a repair and transformation layer, an amphoteric hydroxide layer, an oxide layer and a substrate layer. There is no obvious intersection between the layers. The trend of the specific composition and the depth is shown in FIG. 4, wherein, the thickness of the repair and transformation layer is 1-100 nm, this layer is mainly characterized in that the anti-pitting corrosion of the transformation layer contains Mo element, in the repair layer, trivalent chromium is the surface crystalline skeleton while hexavalent chromium is the filler, and both maintain the stability of the layer elements and increase the corrosion resistance together. The thickness of the amphoteric hydroxide layer is 200-500 nm, this layer is mainly composed of chromium oxide and chromium hydroxide layer. The thickness of the oxide layer is 500-900 nm, this layer is mainly composed of chromium oxide and chromium elementary layer, while the content of the iron elementary layer in this layer is rapidly increased to the content which is equivalent to that of the substrate. The thickness of substrate layer is >900 nm, this layer is the normal composition of the 304 stainless steel substrate. As can be seen from FIG. 2, there is no obvious interface between the substrate layer and the three layers on the surface of the nanocrystalline material, and the binding strength is strong.

The test of the binding ability between the nanocrystalline material according to the present invention and the stainless steel substrate is carried out as follows: the testing sheet including the stainless steel-based nanocrystalline material of the present invention was heated to a preset high temperature and then placed into a cold water to quench, the test was performed for several times repeatedly to observe the adhesion of the bonding layer between the nanocrystalline material and the stainless steel substrate. The thermal shock test on the testing sheet applying the nanocrystalline materials based on the stainless steel was performed according to the standard of GB/T5270-2005/ISO2819: 1980. The testing temperature was increased successively to 100□, 300□, 500□, 800□ and 1000□, the testing sheet did not appear cracks and peeling on the surface. Though the color of the surface was changed a little at high temperature of 800□ and 1000□, the composition of the surface of the nanocrystalline materials was maintained unchanged when tested by X-ray photoelectron spectroscopy. When stretched to a deformation of 30% at a high temperature of 1000° C., the nanocrystalline material had the same stretch ratio as the substrate material.

In the present invention, the commonly used stainless steels (OCr13, 304, 316L, 317L) which have treated by the method according to the present invention were analyzed by X-ray photoelectron spectroscopy element analysis for many times. The composition of the elements was as shown in Table 1:

TABLE 1

Testing result of commonly used stainless steels treated by the method according to the present invention

| Elements | Composition (wt %) |
|---|---|
| Carbon | 0-3 |
| Oxygen | 20-35 |
| Chromium | 40-53 |
| Iron | 10-35 |
| Molybdenum | 1-4 |
| Nickel | 0-4 |
| Silicon | 0-2.5 |
| Calcium | 0-2 |
| Impurity elements | <1 |

By calculating according to the following pitting resistance equivalent $$Pren=1\times Cr+3.3\times Mo+20\times N,$$

the Pren value of various stainless steel surfaces treated by the method according to present invention is increased substantially and is 40-58.

Wherein, the 304 stainless steel treated by the method according to the present invention is analyzed for many times by X-ray photoelectron spectroscopy, and the composition of elements is shown in Table 2:

TABLE 2

Testing result of 304 stainless steel treated by the method according to present invention

| Elements | Composition (wt %) |
|---|---|
| Carbon | 0.83 |
| Oxygen | 32.81 |
| Chromium: | 44.28 |
| Iron | 14.47 |
| Molybdenum | 1.0 |
| Nickel | 3.06 |
| Silicon | 2.43 |
| Calcium | 1.11 |

By calculating according to the following pitting resistance equivalent $$Pren=1\times Cr+3.3\times Mo+20\times N$$

the Pren value of the surface of 304 stainless steel treated by the method according to the present invention is 47.58.

Based on different stainless steel substrates, the specific process of the method according to present invention is as follows:

The process route was: oil degreasing with hot alkaline and etching with alkali; washing with water; oxidizing; washing with water; electrolyzing; densifying; hardening.

A hot sodium hydroxide solution and a solution containing an alkali etching active agent were used to chemically degrease and etch with alkali, the temperature of the solution is controlled at 80-85° C., the time is 10-15 min, hot water with a temperature of 80-85° C. is used for washing for 3-5 min. The amount of the hot sodium hydroxide solution and the solution containing the alkali etching active agent is subjected to immerse the whole stainless steel surface.

The oxidizing solution contains 200-300 g/L of $CrO_3$ and 100-150 g/L of $Na_2MoO_4$. At 75-90□, the pH of the oxidizing solution is adjusted to 0.4-1.5 by adding a $H_2SO_4$ solution, the time for oxidizing is 15-35 min 15-35 min, and then the oxidizing solution was washed.

The composition of the electrolyte contains 100~150 g/L of $CrO_3$, 100~150 g/L of $Na_2MoO_4$, 200~250 g/L of $H_3PO_4$, 50~60 g/L of $Na_2SiO_3$. The pH of the electrolyte is adjusted to 0.5-1.5 by adding a $H_2SO_4$ solution, the temperature is controlled at 40-52° C. The stainless steel piece is taken as cathode. The electrolysis is performed for 10-25 min at an initial intensity of 40 $A/m^2$, and then is performed for 15-30 min at a gradually decreased current intensity. In the electrolyzing step, the current is direct current, the initial current intensity is 40 $A/m^2$, and then the current intensity is decreased gradually according to the formula $i=3+A/t$, wherein i is current intensity, t is time, A is a parameter of 20-30. The electrolyte on the surface is washed after the electrolysis is finished.

The washed film layer is hardened at a temperature of 50-60° C. and a humidity of 60-70% for 3-4 hours, the treatment is finally completed.

The pitting effect of the stainless steel treated by the method according to the present invention is very obvious and the pitting resistance equivalent Pren is between 40 and 58, which is higher than many excellent stainless steel alloys. There is no obvious combining interface between the surface of the stainless steel treated by the method according to the present invention and the stainless steel substrate, and the surface of the treated materials combine with the substrate in an inlaid manner, therefore, there is no obvious fault.

The control of current intensity during electrolyzing is important in the present invention. Short time and large current will lead to insufficient chromium and silicon elements in the honeycomb hole of the stainless steel surface, thereby leading to holes in the middle layer, insufficient atomic packing factor and deteriorated corrosion resistance. Therefore, the current intensity, the time and temperature for electrolyzing and the current intensity which decreases gradually in the later stage of electrolysis will affect the atomic packing factor of the treated stainless steel.

In the method according to the present invention, the temperature and humidity for hardening is very important. When the temperature is too high, the film will age and crack. When the temperature is too low, the film will be soft and especially the filled metal and metal oxide crystalline are easy to fall off from the substrate during the rinsing and friction process.

DESCRIPTION OF FIGURES

Hereinafter, exemplary embodiments of the present invention will be described in detail with reference to the accompanying drawings, in which.

DESCRIPTION OF THE PREFERRED EMBODIMENTS

Further described the present invention in detail in conjunction with specific embodiments below, the examples are given only for illustrating the present invention and are not intended to limit the scope of the invention.

The experimental methods in the following examples are conventional methods unless otherwise specified. The raw materials, reagent materials and the like used in the following examples are commercially available products unless otherwise specified.

Example 1: The Test on Current Control of the Method According to the Present Invention In the method of the present invention, the change in current during electrolysis has a large influence on the atomic packing factor of the treated stainless steel surface. It can be found from the standard ferric chloride corrosion test that the atomic packing factor of the treated stainless steel surface has a great influence on the corrosion results. The change in the coefficient of friction and the change in the corrosion resistance of the treated stainless steel surface were observed by various changes in the electrolysis current, and the results shown that the smaller the coefficient of friction was, the better the corrosion resistance was.

Figure 1:
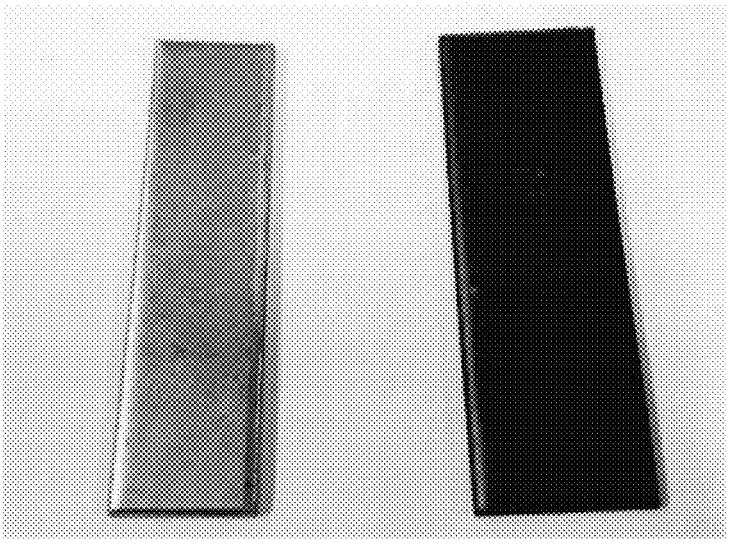
FIG. 1: the left side of the figure is a 304 stainless steel substrate, the right side of the figure is a 304 stainless steel substrate treated by the method according to the present invention.
Figure 2:
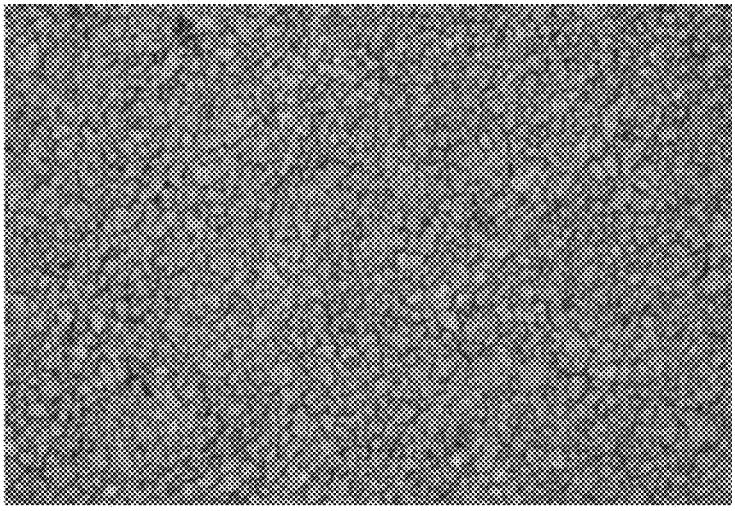
FIG. 2: a stainless steel surface treated by the method according to the present invention.
Figure 3:
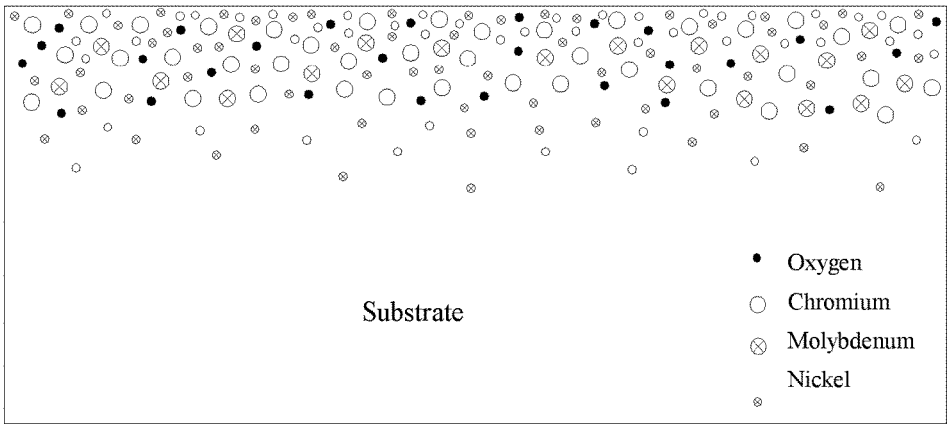
FIG. 3: an element distribution diagram of the stainless steel treated by the method according to the present invention and 304 stainless steel substrate.
Figure 4:
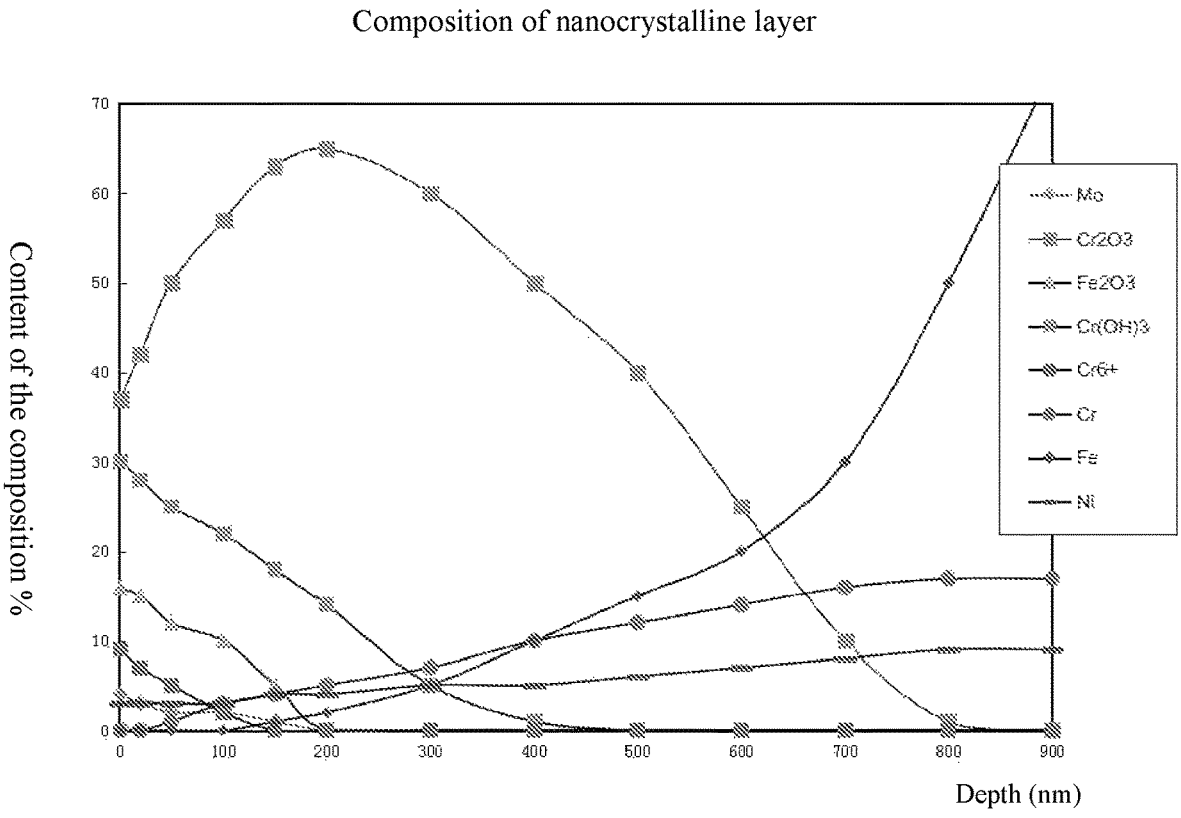
FIG. 4: a trend chart of material composition layer of the stainless steel treated by the method according to the present invention analyzed by X-ray photoelectron spectroscopy.
Figure 5:
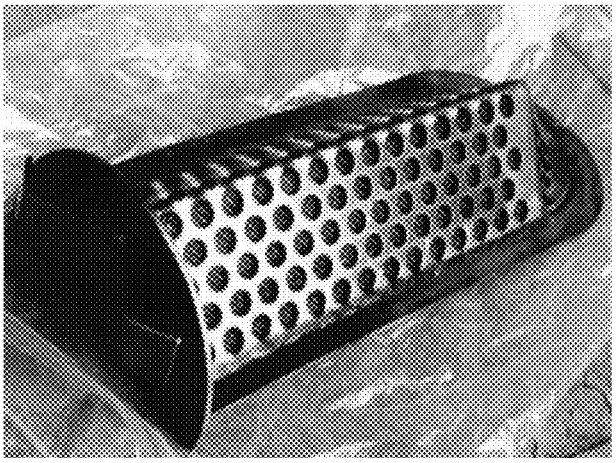
FIG. 5: a stainless steel filter hanger made of 304 stainless steel substrate treated by the method according to the present invention.
Figure 6:
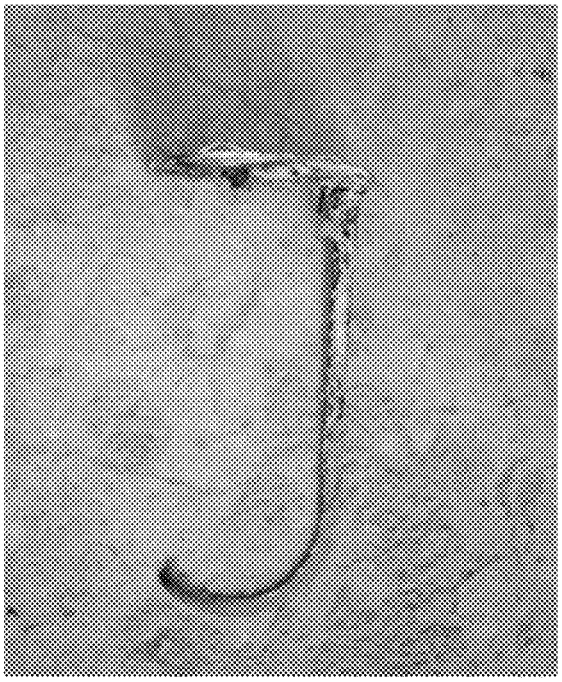
FIG. 6: a 304 stainless steel filter hanger (after being placed for 40 days)
Figure 7:
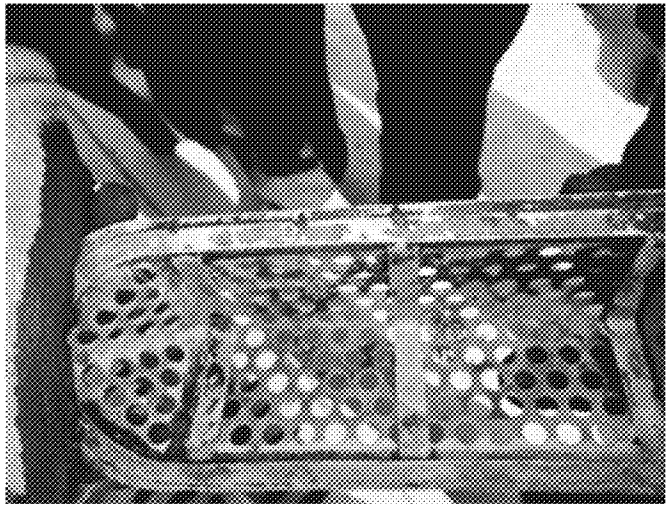
FIG. 7: a stainless steel filter hanger made of 304 stainless steel treated by the method according to the present invention (after being placed for 40 days)
Figure 8:
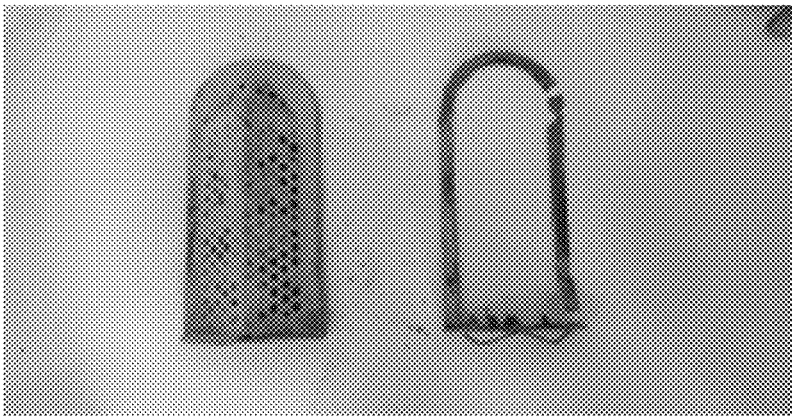
FIG. 8: a stainless steel filter hanger made of 304 stainless steel treated by the method according to the present invention (after being placed in an acid water stripper reflux pump for 3 months)
Figure 9:
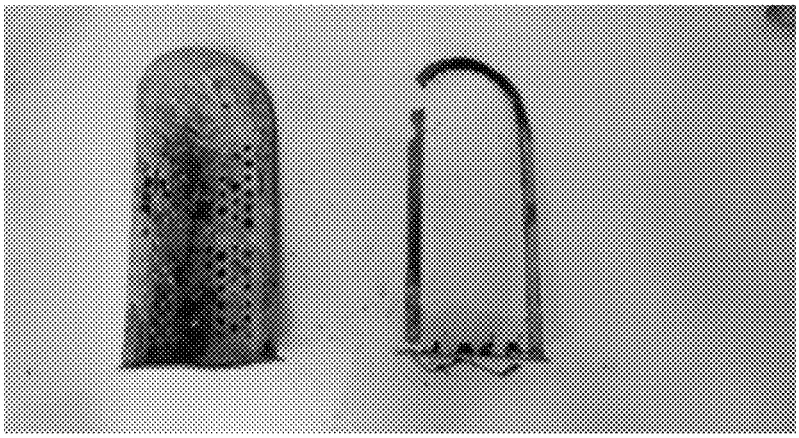
FIG. 9: an ordinary 304 stainless steel filter hanger (after being placed in an acid water stripper reflux pump for 40 days)
Figure 10:
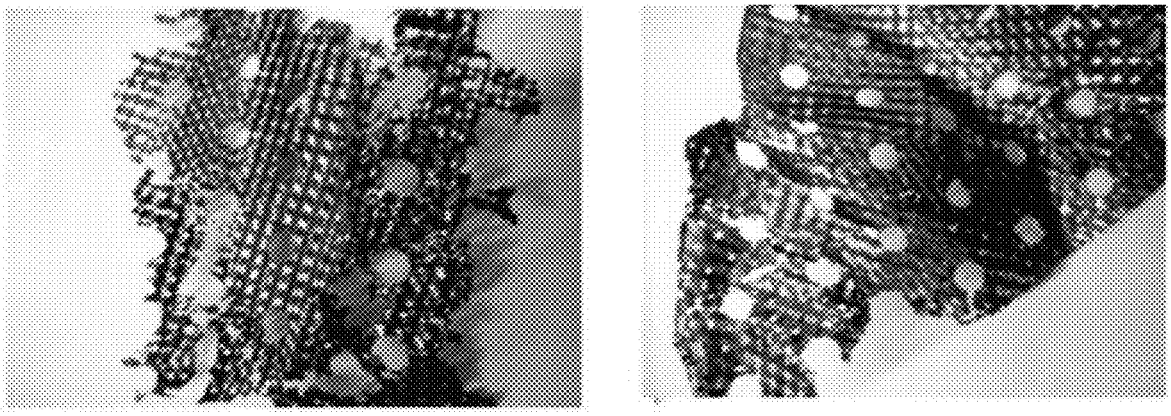
FIG. 10: an ordinary 304 stainless steel filler (after being operated for 1247 days)
Figure 11:
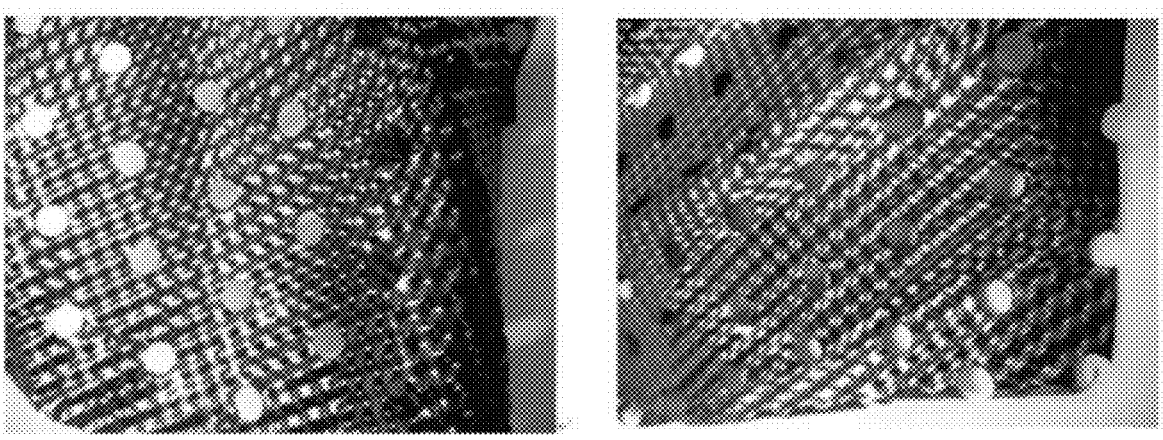
FIG. 11: a 304 stainless steel filler treated by the method according to the present invention (after being operated for 1247 days)
Figure 12:
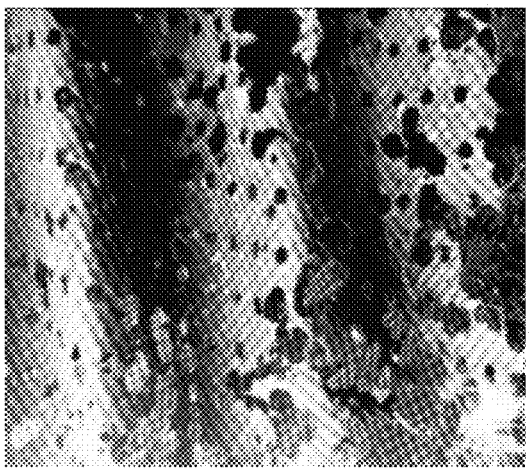
FIG. 12: a 317L stainless steel filler (after being operated for 3 years)
Figure 13:
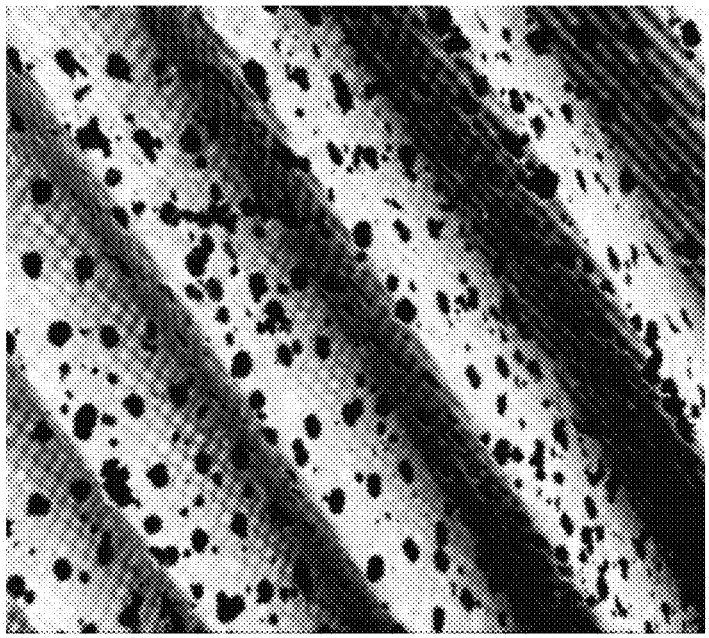
FIG. 13: adjacent area of a 317L stainless steel filler and a 317L stainless steel filler treated by the method according to the present invention (after being operated for 3 years)
Figure 14:
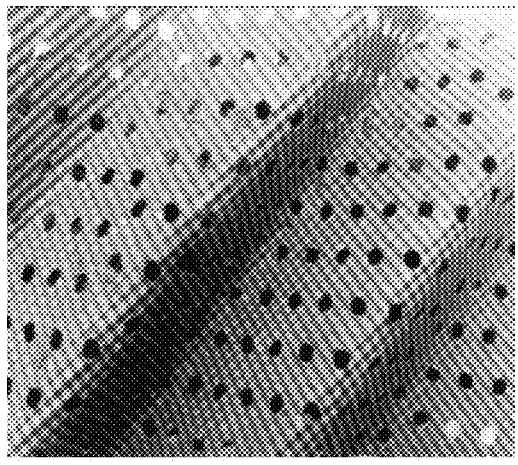
FIG. 14: a 317L stainless steel filler treated by the method according to the present invention (after being operated for 3 years)
Figure 15:
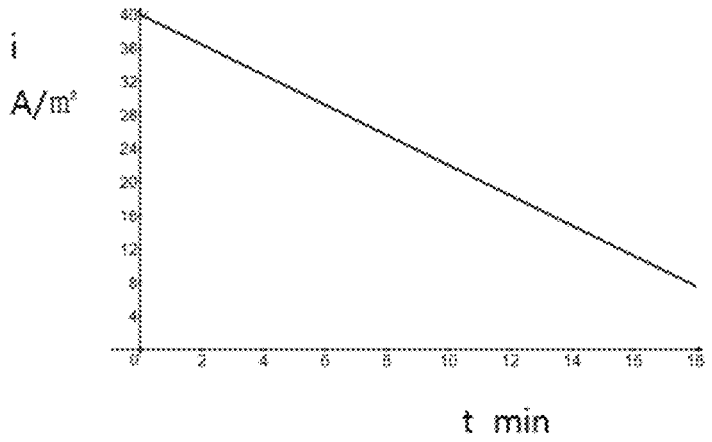
FIG. 15: a current-time profile according to the formula i=40−2.33t (wherein, i is current intensity, t is dense duration time (min)) after electrolyzing for 15 min.
Figure 16:
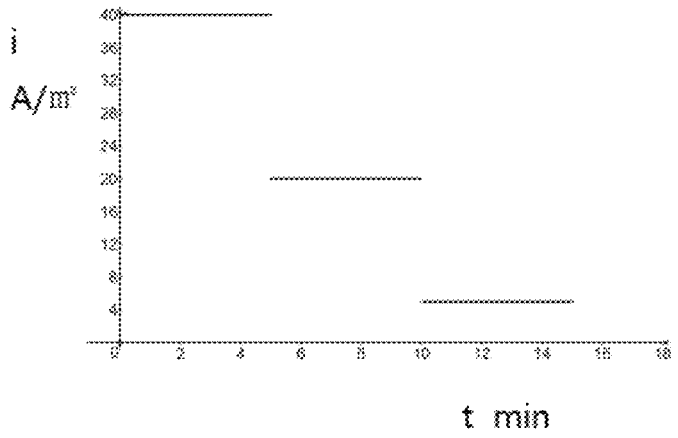
FIG. 16: a current-time profile after electrolyzing for 15 min, wherein at 0-5 min, the current is 40 A/m$^2$; at 5-10 min, the current is 20 A/m$^2$; at 10-15 min, the current is 15 A/m$^2$.
Figure 17:
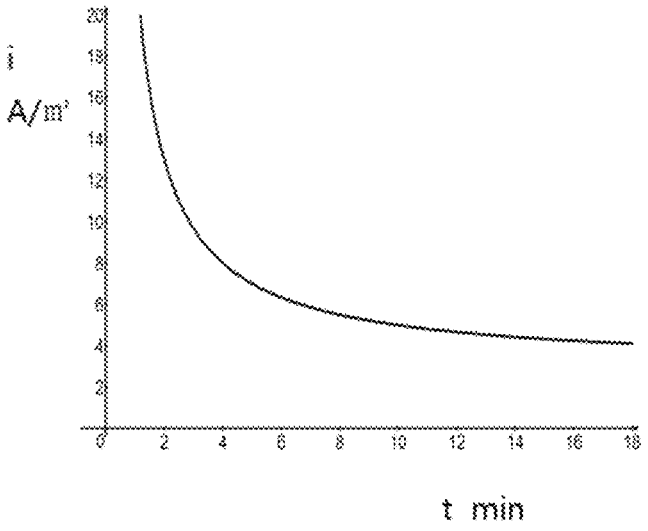
FIG. 17: a current-time profile according to the formula i=30+30/t (wherein, i is current intensity, t is dense duration time (min)) after electrolyzing for 15 min.

As shown in FIGS. 15-17, X axis (horizontal axis) is time (min), Y axis (longitudinal axis) is current intensity (A/m$^2$):

Scheme 1: As shown in FIG. 15, the current intensity of the method according to the present invention was i=40−2.33t (i is current intensity, t is duration time);

Scheme 2: As shown in FIG. 16, the current intensity of the method according to the present invention was: at 0-5 min, the current was 40 A/m$^2$; at 5-10 min, the current was 20 A/m$^2$; at 10-15 min, the current was 5 A/m$^2$;

Scheme 3 (the current was controlled according to the method of the present invention): As shown in FIG. 17, the current intensity of the method according to the present invention is: i=3+A/t (i is current intensity A/m$^2$, t is duration time, A (parameter) is 20-30);

The result was shown in Table 3.

TABLE 4 friction coefficients of a 304 stainless steel substrate treated by the treating method of the present invention

| Schemes | Friction coefficient μ | Corrosion rate of standard ferric chloride g/m$^2$h |
|---|---|---|
| 304 stainless steel substrate (untreated) | 0.131 | 17.68 |
| Scheme 1 | 0.102 | 2.09 |
| Scheme 2 | 0.113 | 4.36 |
| Scheme 3 (the current was controlled according to the method of the present invention) | 0.092 | 1.12 |

Conclusion: Different ways of changing the current lead to different atomic packing factor of stainless steel nano-surfaces. As can be seen from the table, the smaller the friction coefficient g was, the smoother the nano-surface film layer was, and the higher the atomic packing factor of the nano-crystal surface was, this will result in good corrosion resistance.

Example 2: Surface Hardening Test of the Method According to the Present Invention The hardening on the stainless steel surface has a great influence on the corrosion resistance. At present, the hardening of the stainless steel surface is usually dried at room temperature.

In the present invention, the inventors evaluated the corrosion resistance effect of the treated stainless steel surface by anti-flowing corrosion effect under different temperature, humidity and time, to screen the most suitable surface hardening conditions.

The standard ferric chloride corrosion test was carried out under constant temperature and humidity conditions in a flowing corrosive environment. The surface corrosion resistance environment of the 304 substrate treated by the method of the present invention was shown in Tables 4-6.

TABLE 4

Effect of the temperature for hardening on surface corrosion resistance
Effect of the temperature for hardening on surface corrosion resistance (the humidity was controlled at 60%, the time for hardening was 4 h)

| Nos. | Temperature for hardening□ | Corrosion rate of flowing (the flowing rate was 1 m/s) ferric chloride g/m²h |
|---|---|---|
| 1 | Room temperature-Humidity is uncertain | 8.68-2.35 |
| 2 | 30 | 4.09 |
| 3 | 40 | 2.87 |
| 4 | 50 | 1.55 |
| 5 | 60 | 2.41 |
| 6 | 70 | 6.22 |
| 7 | 80 | 10.84 |

A conclusion is drawn from Table 4 that the temperature for hardening has an effect on the hardness of the nano-film layer. When the temperature for hardening was low, the nano-film layer was easy to fall off, while the temperature for hardening was high, the surface of the nano-film layer had cracks. It could be seen from the results of the flowing ferric chloride corrosion test that a suitable temperature for hardening could greatly improve the resistance to corrosion under flowing condition. The suitable temperature was 50~60□.

TABLE 5

Effect of the humidity for hardening on corrosion resistance of surface treated by the method of the present invention
Effect of the humidity for hardening on corrosion resistance of surface treated by the method of the present invention (the temperature was controlled at 50° C., the time for hardening was 4 h)

| Nos. | Humidity for hardening % | Corrosion rate of flowing (the flowing rate was 1 m/s) ferric chloride g/m²h |
|---|---|---|
| 1 | <2 | 11.27 |
| 2 | 20 | 6.58 |
| 3 | 30 | 4.61 |
| 4 | 40 | 2.23 |
| 5 | 50 | 1.78 |
| 6 | 60 | 1.55 |
| 7 | 70 | 1.62 |
| 8 | 80 | 1.76 |
| 9 | 95 | 1.82 |

A conclusion is drawn from Table 5 that the humidity for hardening has an effect on the hardness of the nano-film layer, which similar to that of the temperature. The humidity for hardening was low, the surface of the nano-film layer had cracks, the humidity was high, and the nano-film layer was soft and easy to fall off. It could be seen from the results of the flowing ferric chloride corrosion test that a suitable humidity for hardening could improve the resistance to corrosion under flowing condition. The suitable humidity was 60~70%.

TABLE 6

Effect of the time for hardening on corrosion resistance of surface treated by the method of the present invention
Effect of the time for hardening on corrosion resistance of surface treated by the method of the present invention (the temperature was controlled at 50□, the humidity was 60%)

| Nos. | Time for hardening h | Corrosion rate of flowing (Flow rate 1 m/s) ferric chloride g/m²h |
|---|---|---|
| 1 | 0.5 | 3.51 |
| 2 | 1 | 2.42 |

TABLE 6-continued

Effect of the time for hardening on corrosion resistance of surface treated by the method of the present invention
Effect of the time for hardening on corrosion resistance of surface treated by the method of the present invention (the temperature was controlled at 50□, the humidity was 60%)

| Nos. | Time for hardening h | Corrosion rate of flowing (Flow rate 1 m/s) ferric chloride g/m²h |
|---|---|---|
| 3 | 2 | 1.88 |
| 4 | 3 | 1.56 |
| 5 | 4 | 1.55 |
| 6 | 6 | 1.53 |
| 7 | 12 | 1.49 |
| 8 | 24 | 1.45 |

A conclusion is drawn from Table 6 that from comparative data, the longer the time for hardening was, the better the hardening effect was. The longer the time was, the higher the stability of the nano-film layer was. However, considering the processing time, the suitable time was 3~4 h.

Example 3: Treating a Stainless Steel Surface (304 Substrate) by the Method According to the Present Invention (1) A sodium hydroxide solution with a concentration of 7% and a solution containing a HDW-1050 alkali etching additive with a concentration of 0.5% were used to chemically degrease and etch with alkali the stainless steel surface (304 substrate). The total amount of the whole solution was subjected to immerse the whole stainless steel surface. The temperature of the solution was controlled at 80° C., the time was 15 min; and then water with a temperature of 80° C. was used for washing for 3 min;

(2) the oxidizing solution contained 300 g/L of $CrO_3$, 140 g/L of $Na_2MoO_4$. At 78° C., the pH of the oxidizing solution is adjusted to 1.3 by adding a 98% $H_2SO_4$. The time for oxidizing was 15 min, water was used for washing at room temperature for 3 min after oxidation.

(3) the composition of the electrolyte contained 100 g/L of $CrO_3$, 100 g/L of $Na_2MoO_4$, 200 g/L of $H_3PO_4$, 55 g/L of $Na_2SiO_3$. The pH of the oxidizing solution is adjusted to 1.3 by adding a 98% $H_2SO_4$, the temperature was controlled at 40° C. The stainless steel piece (304 substrate) was taken as cathode, based on the surface area of the stainless steel, the electrolysis was performed at the current intensity of 40 A/m² for 10 min, then was performed at a gradually reduced current intensity according to the formula $i=3+30/t$ (i is current intensity A/m², t is duration time) for 15 min, and then the electrolyte on the surface of the stainless steel piece was washed water at room temperature.

(4) placing the stainless steel piece (304 substrate) into an environment with a temperature of 55□ and a humidity of 60% for hardening for 3 hours, and then a nanocrystalline material based on the stainless steel surface (304 substrate) was obtained.

After being treated by the method according to the present invention, the stainless steel surface (304 substrate) contained 0.83% of carbon, 32.81% of oxygen, 44.28% of chromium, 14.17% of iron, 1.0% of molybdenum, 3.06% of nickel, 2.73% of silicon, 1.11% of calcium and with the balance being impurity elements.

Example 4

An acid water stripping unit reflux system from Ningxia Coal Industry Group Co., Ltd. was seriously corroded, especially, the top reflux pipe, the return pump, the return tank and the condenser at the top of the tower had severe corrosion and serious leakage. The replacement of the equipment in the reflux system was short, which affected the acid water treatment of the equipment.

TABLE 7

| Water analysis data after washing acids | |
|---|---|
| Items | Acid water stripping unit |
| Ammonia nitrogen in incoming water (mg/L) | 3900 |
| Sulfide in incoming water (mg/L) | 72 |
| Petroleum in incoming water (mg/L) | Not detected |
| COD in outer delivery water (mg/L) | did not cause excessive COD |
| Ammonia nitrogen in outer delivery water (mg/L) | 5-30 |
| Sulfide in outer delivery water (mg/L) | Not detected |
| Petroleum in outer delivery water (mg/L) | Not detected |
| PH in reflux | 8.6-10 |
| Iron ion in reflux (mg/L) | Total iron 39.6 |
| Cl− in reflux (mg/L) | Detected maximum was 11000 |
| Non-condensable gas $H_2S$ content (%) | <2 |
| Non-condensable gas $NH_4^+$ content (%) | Total nitrogen 50 |
| Non-condensable gas $CO_2$(%) | 50 |

Due to high content and fast flow rate of $Cl^-$ in the reflux of the acid water stripping unit reflux system and the caused washing and corrosion on the filter hanger piece was fast. When the filter hanger made of 304 stainless steel was tested, the result showed that there was visible corrosion to the naked eye after being placed for one week. The 304 stainless steel filter mesh is corroded out and the whole skeleton structure is also corroded out after being placed for 40 days.

After treating the 304 stainless steel by the method according to the present invention, the filter hanger was tested. The result showed that there was no any corrosion after being placed for one week. After being placed for 40 days, the stainless steel filter hanger embrittle, and the filter mesh can be broken by hand, but the overall skeleton structure and the filter mesh were kept intact. The overall skeleton structure was still kept intact after being placed for 3 months.

Example 5

A branch company of China Petroleum & Chemical Corporation designed high-sulfur and high-acid crude oil as the crude oil in an atmospheric and vacuum distillation device of a crude oil deterioration reconstruction project. A 304 filter and a 304 filter containing a nano surface layer were placed at the bottom of the third section of a packed vacuum tower. Specific temperature was shown as Table 8:

TABLE 8

| Minus three lines temperature (□) | Sulfur content | Acid value | Carbon residue content |
|---|---|---|---|
| 213~331.2 | 0.77m % | 1.06 | 2.26% |

After being operated for 1247 days, it can be seen from the scene that the 304 substrate was corroded, become thin, and severely embrittled. While after being treated by the method according to the present invention, the stainless steel 304 showed no significant corrosion.

Example 6

A branch company of China National Offshore Oil Corporation designed low-sulfur and high-acid crude oil as the crude oil in an atmospheric and vacuum distillation device. The temperature of the fifth section of the vacuum tower was 400° C., the sulfur content was 0.35%, the acid value was 2.65-3.09 and the filter substrate was 317L. After being operated for 3 years, it was seen from the scene that the 317L substrate had obvious corrosion, while the 317L substrate treated by the method according to the present invention had no obvious corrosion with an intact surface film and visible gloss.

The invention claimed is:

1. An anti-corrosion method of a stainless steel surface, comprising the following steps:

(1) chemically degreasing and etching with alkali the stainless steel surface using a sodium hydroxide solution and a solution containing an alkali etching active agent, followed by washing with water;

(2) oxidizing the stainless steel surface treated in the step (1) by an oxidizing solution, followed by washing with water;

(3) immersing the stainless steel surface treated in the step (2) as a cathode in an electrolyte to electrolyze, followed by washing with water; and (4) placing the stainless steel surface treated in the step (3) at a temperature of 50-60° C. and a humidity of 60-70% for hardening, wherein in the step (3), the electrolyte contains 100-150 g/L of $CrO_3$, 100-150 g/L of $Na_2MoO_4$, 200-250 g/L of $H_3PO_4$ and 50-60 g/L of $Na_2SiO_3$; a current intensity is 40 to 5 A/m$^2$ with an initial current intensity of 40 A/m$^2$, and then the current intensity is gradually reduced to 5 A/m$^2$ according to formula $i=3+A/t$, wherein i is the current intensity, t is time, and A is a parameter of 20-30.

2. The method of claim 1, which characterized in that, in the step (1), the sodium hydroxide solution and the solution containing the alkali etching active agent is 80-85° C.

3. The method of claim 1, which characterized in that, in the step (2), the oxidizing solution contains 200-300 g/L of $CrO_3$ and 100-150 g/L of $Na_2MoO_4$.

4. The method of claim 1, which characterized in that, in the step (3), a temperature of the electrolyte is 40-52° C.

5. The method of claim 1, which characterized in that, in the step (4), a time for hardening treatment by placing is 3-4 hours.

6. The method of claim 1, which characterized in that, the stainless steel surface treated by the method is at least one surface selected from surfaces of: stainless steel plate corrugated filler, stainless steel wire mesh filler, stainless steel loose filler, tray plate, stainless steel float valves, various fasteners and connectors.

7. The method of claim 1, which characterized in that, in the step (1), a concentration of the sodium hydroxide solution is 6.5-8%.

8. The method of claim 1, which characterized in that, in the step (1), a concentration of the solution containing the alkali etching active agent is 0.3-0.5%.

9. The method of claim 1, which characterized in that, in the step (1), the alkali etching active agent is ethoxy modified polytrisiloxane.

10. The method of claim 1, which characterized in that, in the step (1), the chemically degreasing and etching with alkali treatment is performed for 10-15 minutes.

11. The method of claim 1, which characterized in that, in the step (1), the washing with water is performed by using water with a temperature of 80-85° C. for 3-5 min.

12. The method of claim 1, which characterized in that, in the step (2), a temperature of the oxidizing solution is 75-90° C.

13. The method of claim 1, which characterized in that, in the step (2), a pH of the oxidizing solution is 0.4-1.5; the pH of the oxidizing solution is adjusted to 0.4-1.5 by adding a $H_2SO_4$ solution into the oxidizing solution; and a concentration of the $H_2SO_4$ solution is 98%.

14. The method of claim 1, which characterized in that, in the step (2), the oxidizing is performed for 15-35 minutes.

15. The method of claim 1, which characterized in that, in the step (2), the washing with water in the step (2) is performed cyclically by using water at 25-40° C. for 3-5 minutes; and a pH of the water is >3.

16. The method of claim 1, which characterized in that, in the step (3), a pH of the electrolyte is adjusted to 0.5-1.5 by adding a $H_2SO_4$ solution into the electrolyte; and a concentration of the $H_2SO_4$ solution is 98%.

17. The method of claim 1, which characterized in that, in the step (3), a time for electrolyzing is 25-55 minutes.

18. The method of claim 1, which characterized in that, in the step (3), the electrolysis comprises electrolyzing for 10-25 minutes at an initial current intensity of 40 $A/m^2$, and then electrolyzing at a current intensity gradually reduced to 5 $A/m^2$ during 15-30 minutes.

19. The method of claim 1, which characterized in that, in the step (3), the washing with water is performed cyclically by using water 25-40° C. for 3-5 minutes; and a pH of the water is >3.

* * * * *